US007435264B2

(12) United States Patent
Kiff

(10) Patent No.: US 7,435,264 B2
(45) Date of Patent: Oct. 14, 2008

(54) SCULPTURED AND ETCHED TEXTILE HAVING SHADE CONTRAST CORRESPONDING TO SURFACE ETCHED REGIONS

(75) Inventor: Mark Kiff, Greer, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/706,807

(22) Filed: Nov. 12, 2003

(65) Prior Publication Data

US 2005/0100705 A1 May 12, 2005

(51) Int. Cl.

| | |
|---|---|
| ***D06Q 1/02*** | (2006.01) |
| ***D06Q 1/06*** | (2006.01) |
| ***D06Q 1/00*** | (2006.01) |
| *B32B 3/02* | (2006.01) |
| *B32B 33/00* | (2006.01) |

(52) U.S. Cl. ..... 8/114.6; 8/114; 8/115; 8/929; 428/89; 428/88

(58) Field of Classification Search ..... 428/89, 428/88; 8/114.6, 114, 115, 929
See application file for complete search history.

(56) References Cited

U.S. PATENT DOCUMENTS

| | | | | |
|---|---|---|---|---|
| 705,977 | A | 7/1902 | Timme | |
| 1,513,370 | A | 10/1924 | Cadgène et al. | |
| 1,655,414 | A | 1/1928 | Flory | |
| 2,815,558 | A * | 12/1957 | Bartovics et al. | 428/89 |
| 3,849,157 | A * | 11/1974 | Palmer et al. | 8/497 |
| 3,849,158 | A * | 11/1974 | Palmer et al. | 8/497 |
| 3,849,159 | A * | 11/1974 | Palmer et al. | 8/497 |
| 3,856,598 | A * | 12/1974 | Gregorian et al. | 156/85 |
| 3,874,958 | A * | 4/1975 | Scholtis et al. | 216/7 |
| 3,945,791 | A * | 3/1976 | Bohrn | 8/497 |
| 3,953,164 | A * | 4/1976 | Boba et al. | 8/115 |
| 4,188,430 | A * | 2/1980 | DeBernard et al. | 428/88 |
| 4,215,987 | A * | 8/1980 | Mueller et al. | 8/115 |
| 4,255,231 | A * | 3/1981 | Boba et al. | 216/83 |
| 4,260,390 | A * | 4/1981 | Lewis | 8/481 |
| 4,286,955 | A * | 9/1981 | Lewis | 8/115.6 |
| 4,290,766 | A * | 9/1981 | Burns et al. | 8/491 |
| 4,345,909 | A | 8/1982 | Guth et al. | |
| 4,353,706 | A * | 10/1982 | Burns et al. | 8/114.6 |
| 4,398,913 | A | 8/1983 | Buhler et al. | |
| 4,413,998 | A | 11/1983 | Guth et al. | |
| 4,415,331 | A * | 11/1983 | Dusenbury et al. | 8/114.6 |
| 4,417,897 | A | 11/1983 | Stahl et al. | |
| 4,443,505 | A * | 4/1984 | Ehrenfeld, Jr. | 428/89 |

(Continued)

*Primary Examiner*—Cheryl Juska
(74) *Attorney, Agent, or Firm*—John E. Vick, Jr.

(57) ABSTRACT

A textile is disclosed having regions of color contrast and corresponding regions of sculptured three-dimensional surface geometry. Furthermore, one or more methods of making such a textile also are disclosed. The textile includes a first side having first regions and second regions in a predetermined pattern. The first and second regions differ in color shade values due to the etching of the textile, which has the effect of degrading or dissolving fiber material from the second regions, thereby providing a three dimensional sculpted geometry and a color contrast between etched and non-etched areas. Screen printing is applied using an extremely strong acidic or alkali composition paste upon the textile, followed by heating. Then, a washing step and a drying step results in a product having a color shade difference between etched areas and non-etched areas having differing ΔL* color shade values using L*a*b* color space measurement techniques.

3 Claims, 5 Drawing Sheets

U.S. PATENT DOCUMENTS 4,631,067 A 12/1986 Hussamy
4,846,845 A 7/1989 McBride et al.
5,476,518 A * 12/1995 Caleshu ..... 8/115.69
5,861,044 A * 1/1999 Crenshaw ..... 8/115
6,042,925 A * 3/2000 Kerr et al. ..... 428/89
6,494,925 B1 12/2002 Child et al.
7,021,085 B2 * 4/2006 Ikeda et al. ..... 66/191
2003/0051298 A1 * 3/2003 Child et al. ..... 8/494
2005/0053757 A1 * 3/2005 Andersen et al. ..... 428/88

* cited by examiner

*FIG. −4−* a*, b* CHROMATICITY DIAGRAM

CHROMATICITY AND LIGHTNESS

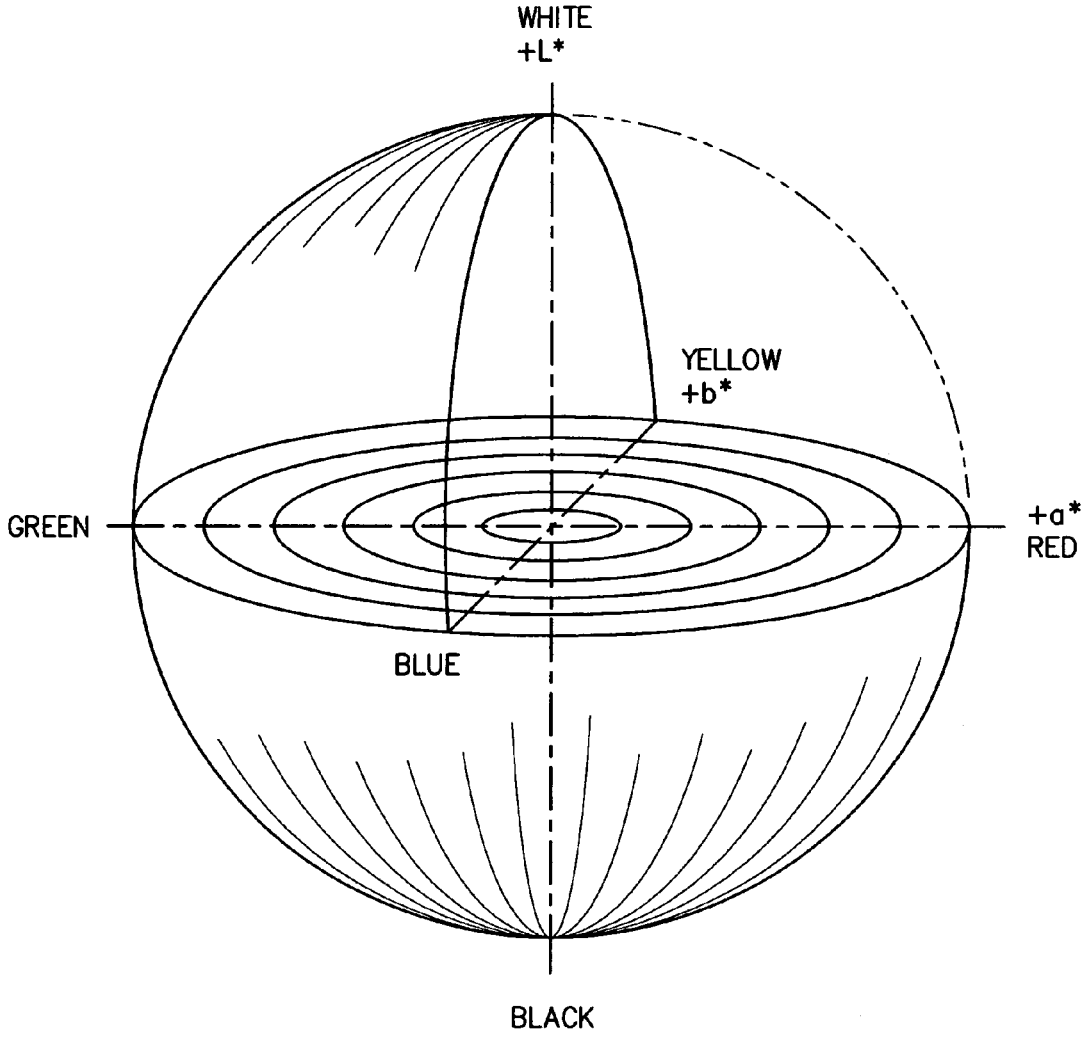
*FIG. —6—*

SCULPTURED AND ETCHED TEXTILE HAVING SHADE CONTRAST CORRESPONDING TO SURFACE ETCHED REGIONS

BACKGROUND OF THE INVENTION

In the manufacture of textile articles, the surface properties of a textile surface may desirably be changed in ways that consumers find pleasing. For example, a typical pile-containing textile may be treated to provide a sculptured (i.e. "carved") three-dimensional surface geometry by known methods. Such methods include for example air jet carving, such as the Millitex® process by Milliken and Company. This process is capable of producing a more luxurious and appealing textile or fabric surface in part by dissolution or elimination of fibers upon various preselected regions of a pile-containing surface by application of very hot air.

Another method of providing a three-dimensional surface to a textile is by applying a chemical etch to the surface of the textile. Such a chemical etch may be strongly basic, or alternatively strongly acidic, to erode or eliminate pre-selected portions of a pile-containing surface. Such etching methods result in a surface having a three-dimensional surface geometry, with areas of reduced pile height corresponding to areas upon the surface of the textile which receive the chemical etch.

Chemical etching is practiced in the industry in certain applications by applying a caustic or acid material to a textile. This application results in dissolving or wearing away a portion of the fibers of the textile, which has the effect of carving the textile to achieve a three-dimensional geometry or appearance.

It is also desirable to provide color or shade variation in textiles. For example, consumers respond positively to textiles which have color contrast in predefined patterns upon a pile surface. Various methods in the industry are known for providing color shade patterns or variations upon a textile surface.

Color shade matching, or color testing, may be performed on textiles. In the industry it is common to measure color shade using a three-dimensional color space coordinate. That is, three dimensions of color may be measured. The first dimension L*, refers to a light or dark value. The second dimension of color is a red/green, and this second color space coordinate is designated a*. A negative (i.e. below zero) value for a* is a green, and a positive value for a* is a red. The third color space coordinate is b*. This coordinate is yellow/blue, with yellow being represented by a positive number, and blue being represented by a negative number. The method of color space measurement described as L*a*b* color space method was devised in about 1976 to provide more uniform color differences in relation to visual differences. Color spaces* such as these are now used throughout the world for color communication, and are known as generally accepted standards in the industry. A "color space" refers generally to a method of expressing the color of an object or a light source using some kind of notation, such as numbers.

U.S. Pat. No. 4,417,897 to Stahl et al is directed to a process for preparing white or colored burn-out effects on textile materials containing hydrophobic fibers and cellulose fibers. In the process, one applies to the material a dyeing liquor or printing paste containing at least one disperse dyestuff.

U.S. Pat. No. 6,494,925 to Child et al is directed to a sculptured pile fabric having both a printed pattern and a sculpted surface having various pile heights. A chemical sculpting method is disclosed in which the height of the pile surface is selectively reduced in a pattern configuration, followed by an overall "dilute" dying process. U.S. Pat. No. 4,846,845 to McBride et al. is directed to a process for sculpting pile fabrics which comprises contacting the pile fabric surface with a fiber degrading composition. The resulting products produced by following the teachings of this particular patent do not show any substantial color contrast between etched and non-etched areas.

What is needed in the textile industry are improved products and methods for producing textile products which have desirable color contrast in predefined patterns, and which have desirable sculptured three-dimensional surface geometry. Textiles which have a color shade differential between (1) full pile height areas, and (2) carved or etched areas with reduced pile height, would be particularly desirable. Furthermore, methods of achieving such products in a more efficient manufacturing process are very desirable. The invention is directed to such products and methods for making such products.

BRIEF DESCRIPTION OF THE DRAWINGS

A full and enabling disclosure of this invention, including the best mode shown to. one of ordinary skill in the art, is set forth in this specification. The following Figures illustrate the invention:

FIG. 6 is a graphic representation of a color solid for L*a*b* color space.

DETAILED DESCRIPTION OF THE INVENTION

Figure 1:
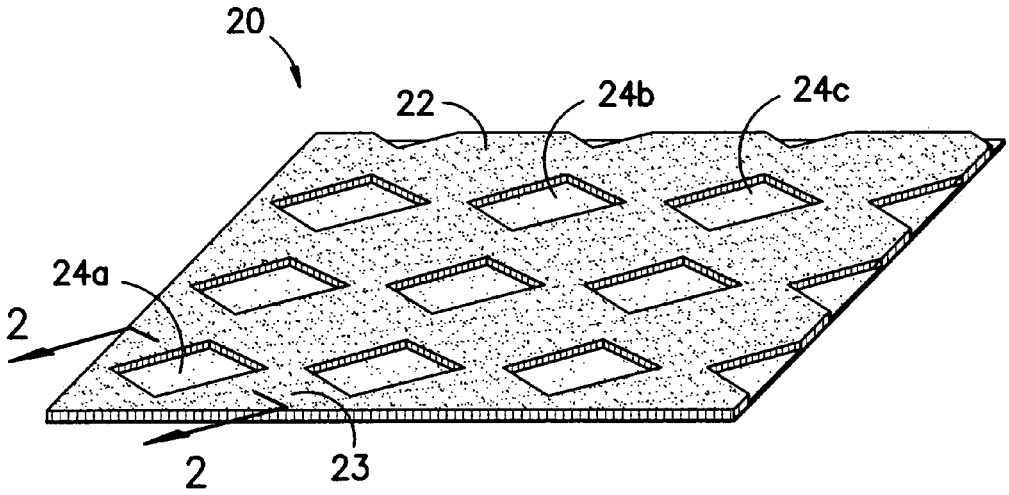
FIG. 1 is a perspective view of a textile with a surface having color contrast and three-dimensional surface geometry.

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention.

Surprisingly it has been discovered that it is possible to provide a color shade contrast and differential that corresponds with carved or etched areas on a textile. In the case of polyester pile fabrics, etching of such a pile-containing fabric may occur by providing a pile fabric which previously has received upon the pile surface an unfixed dye. Then, this fabric which has been treated with unfixed dye may be dried and screen printed. Screen printing (also known as "etching") is applied using an extremely strong alkali paste upon the fabric, followed by heating. The dye is fixed in a subsequent step.

A washing step and a drying step results in a product having a color shade difference between etched areas and non-etched areas having a ΔL* value. For some embodiments of the invention, this difference may be at least about 10 percent. In other embodiments, the difference may be as much as 10%, 25%, 35%, or even 40-50%, or more. The textile surface patterns that result are geometrically three-dimensional due to erosion/degradation of fiber in pre-selected regions. The etched regions are of different color shade as compared to non-etched regions, which provides a surprisingly attractive physical appearance.

The process includes, in one embodiment, the application of an extremely strong alkaline paste upon an unfixed base substrate. Depending upon the selection of the base dyes and the degree of fixation prior to etching, the resulting pattern may be a tone-on-tone pattern with the base dye, or may be of a different shade than the dyed base fabric. It is believed that the application of the caustic (or acid, in other embodiments) to the fibers of the substrate which contain unfixed dye causes the unfixed dye to: (1) become chemically denatured and therefore exhibit less color intensity, or (2) wash out away from the fibers during the process, or perhaps both. In any event, without being limited to any theory of application, the result is a color shade differential between the etched and non-etched areas which corresponds to the boundaries of those areas or regions which receive chemical etch treatment.

The substances or processes that can be used to "carve" or etch textile fibers include sodium hydroxide. In general, polyester fibers are etched by caustic (basic) substances, while polyamide or nylon fibers are etched by acidic etching materials or paste. "Paste" refers in general to any semi-solid substance which may be used in connection with a masking device (such as a print screen) to selectively etch chemically certain portions of a textile, while specifically avoiding chemical etching of other predetermined portions of the textile. The amount of paste employed and the screen printing procedure used in a given application will vary in the practice of the invention. The process and procedure may be tuned or specified for a particular application.

The base textile, or fabric, can be essentially any known textile fabric having a pile capable of receiving a carve or etch upon its surface, and which also is capable of receiving a dye application. For purposes herein, a "pile" refers to any lofted material, chenille, flocked, ribbed, corderoy, felt, or napped material. A knitted or woven textile may be preferred, but other substrates can be employed as well. Polyester knits are particularly suitable for the application of the invention, but other natural or synthetic fibers can be used in such a textile. The products which can be produced may find application in numerous end uses, including for example automotive body cloth for the interior of an automobile. The yarn employed is typically greige yarn, but in various other applications can as well be piece-dyed yarn. Yarn can be polyester, nylon, acrylic, polypropylene, PTT, PLA, nylon 6,6, other nylons, and/or other condensation polymer materials.

In one particular application of the invention, it has been useful to employ sodium hydroxide in a concentration of about 23.5% by weight, for example. However, other caustic substances, or acidic substances, can be used in such an etch. In general, oxidizers, polyethylene glycols, polypropanol, esters, and/or other peroxide generators also can be employed as etching materials. The concentration will vary depending upon the particular application at issue. Other methods and processes for producing such a color shade differential that do not include the employment of a chemical etch are within the scope of the invention as well. The invention is not limited to only chemical etch processes.

In some applications of the invention, there could be multiple pile height areas, such that a first etched region and a second etched region were provided, each region having its own height. In these applications, then, a three pile height product could be produced, having for example three different color shade areas corresponding to the different areas or regions of pile height. This could be achieved by using multiple screens, as a further elaboration of that provided below. Other applications could employ 4 pile height areas with 4 shade regions, or more. There is no limit to the number of pile height regions with corresponding shade differential regions that could be developed.

After the textile is etched, it may be desirable to print color upon the textile surface. Methods of providing color into the tallest pile height area could include customary printing upon a print range. For etched areas, it would be possible to use solution dyed ground yarns, as one example, to provide such color down in the etched region. In other applications, it may be possible to add ink colorant directly into the etching composition, thereby coloring the etched region during the actual etching process. This could produce a final product that is printed upon both the first region and the eroded second region, with color provided in relatively exact registration with the pile height differential regions.

FIG. 1 shows one embodiment of the invention comprising a textile 20 having color contrast and three-dimensional surface geometry corresponding to the areas which exhibit color contrast. The textile has a first side 22 having at least one first region 23. A second side 28, opposite first side 22, is also shown in FIG. 2.

Figure 2:
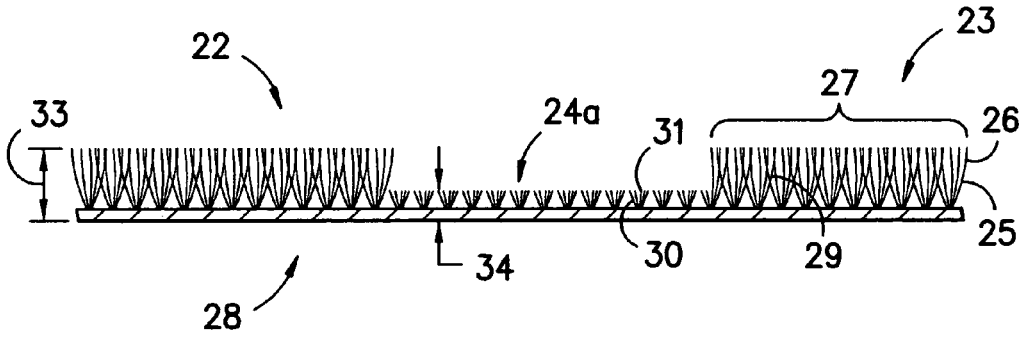
FIG. 2 shows a cross section of the textile of FIG. 1 taken along line 2-2.

FIG. 2 is a cross sectional view taken along line 2-2 of FIG. 1. The first region 23 includes a pile 29, shown in FIG. 2. The pile 29 is comprised of first yarns 25 having first distal ends 26. The first distal ends 26 collectively form an upper plane 27 of said first region 23 of said textile 20. The first yarns 25 have applied thereon a dye, which provides visual color. The first region 23 includes a first color shade having a given intensity and color value. The first region 23 provides a first pile height 33 (shown on the left side of FIG. 2), while the second region 24*a* provides a second pile height 34, which is less (i.e. shorter) than the first pile height 33.

Furthermore, the textile 20 typically will include second regions 24*a-c* upon the first side 22, which may be provided in a predetermined and desirable pattern in connection with the first region 23. The second region 24*a*, for example, comprises a plurality of second yarns 30 having respective second distal ends 31, wherein at least a portion of the second distal ends 31 are eroded to a position beneath the upper plane 27 of the first region 23.

Further, the second regions 24*a-c* exhibit a second color shade. The first color shade of the first region 23 and the second color shade of the second regions 24*a-c* differ in L* value. In some embodiments, this difference may be at least about 10 percent, while in other embodiments, it may be 10-50% or even more, depending upon the fiber type, processing conditions, etch composition, concentration of paste, and other factors.

In FIG. 2, the first region 23 provides a first pile height 33 (see FIG. 2), which is taller or higher than the second height 34 of the second regions 24. The erosion which occurs upon the fibers in the second region may be seen by reference to this pile height difference in FIG. 2. FIG. 2 shows a cross sectional view along line 2-2 of FIG. 1.

Figure 3:
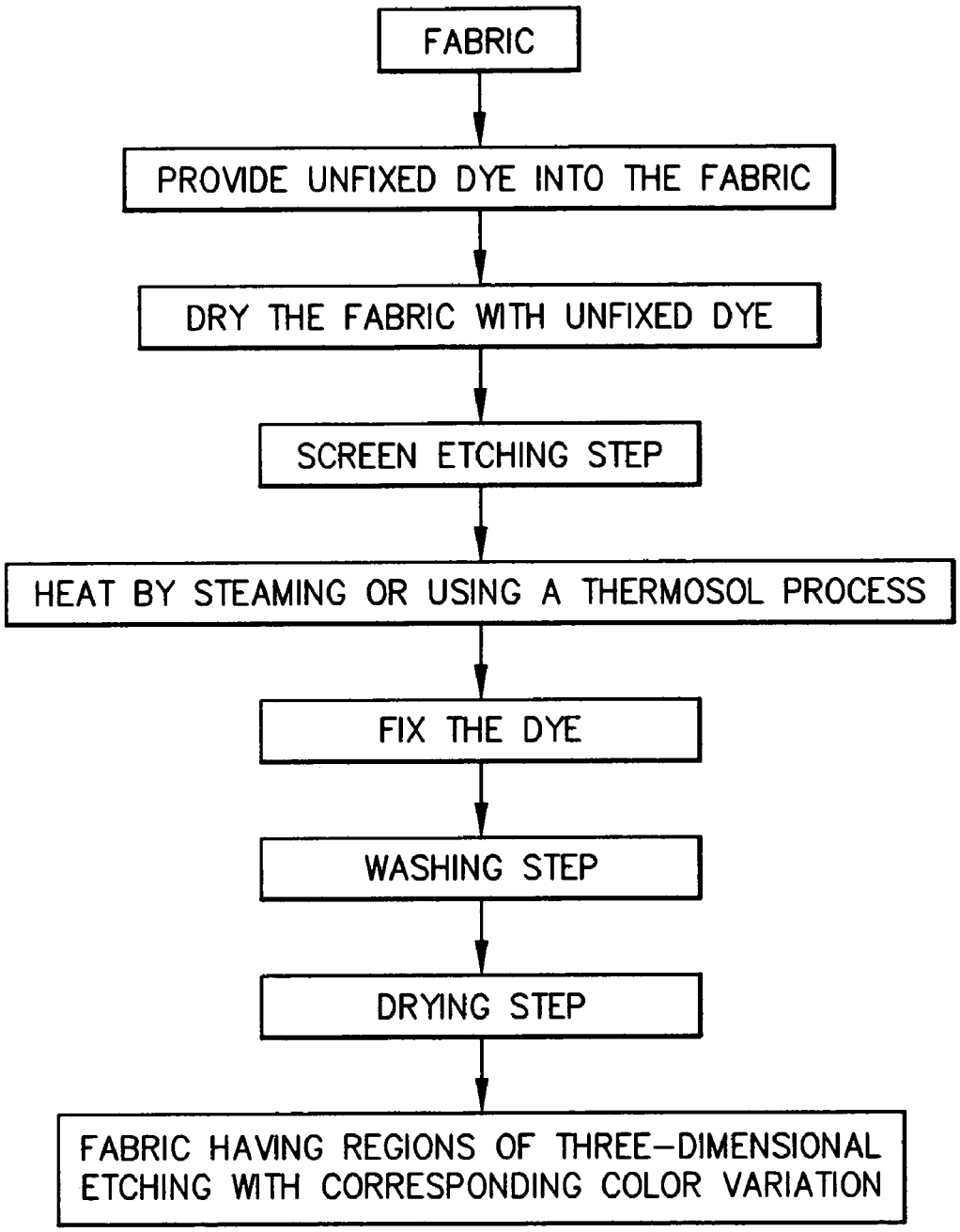
FIG. 3 depicts a process or method for making a textile or fabric having regions of three-dimensional geometry by etching, with corresponding color variation to correspond with the etched areas.

FIG. 3 shows a schematic of one method of making a textile 20 as shown in FIGS. 1-2. In FIG. 3, a textile 20 (or base fabric, collectively referred to herein as "substrate") is provided. Unfixed dye is applied to the textile 20. A dye base shade is applied without chemically fixing the dyes to the fibers of the textile. "Fixing" a dye refers to the chemical or thermodynamic change effected upon a dye molecule that causes the dye molecule to firmly attach itself to a fiber, and/or exhibit color. This method of dye application can be accomplished by any method of continuous dyeing.

Examples of possible methods of continuous dyeing include, but are not limited to: pad dyeing, blotch screen printing, ink jet printing, spraying, foam dyeing, exhaust dyeing, sublimation dyeing, dye injection, beam dyeing and beck dyeing. Drying may employ a drying profile which can be altered to achieve a desired degree of dye fixation. Fabrics with no dye fixation during drying can be altered to achieve a desired degree of dye fixation. Fabrics with no dye fixation during drying and with appropriate dyes can be discharged to white. Using higher temperatures or longer dwell times, some fixation of the dyes can occur and it may be possible to create tone-on-tone discharging in etched areas. Furthermore, etched areas will desirably show color shade differential as compared to the non-etches areas. This may result in an etched area having a lighter shade than the non-etched area, or an etched area with a darker shade, although the former is more likely.

Next, a screen etching step may be performed, with acid or base, depending upon what type of fibers are to be eroded or diminished. For polyester fabrics, it is desirable to print a strong alkaline paste upon the base fabric in areas to be etched. This screen etching step is performed upon a fabric having a dye that is not yet fixed, or is only partially fixed. A second screen etching step can be performed, to form a third area or region having yet another pile height (not shown in Figures).

Following this screen etching process, color may be printed into areas of the fabric not covered by alkaline paste to provide further design effects. However, such a printing step is optional, and is not required in the practice of the invention. This optional printing step is not shown in FIG. 3. Also, it may be possible to provide an ink colorant to said etched region by providing such a colorant in the etch paste composition, which would give the possibility to color more darkly the etched region, as compared to the non-etched region or regions.

In the practice of the invention, one may heat the fabric, as in a high temperature steamer, or in a thermosol process in a tenter frame apparatus. Once the dye is chemically fixed by heating, it is then desirable to wash and dry the fabric or textile 20. The final product may include multiple first regions which are positioned so as to be inter-dispersed within multiple second eroded regions. The fabric, therefore, includes regions of three dimensional etching with corresponding color variation in which the color contrast is applied to essentially the same regions or boundaries as the etched regions.

Color Space Measurement

The L*a*b* color space (also referred to as CIELAB) is presently one of the most popular color space for measuring object color and is widely used in virtually all fields. It is one of the uniform color spaces defined by CIE in 1976 in order to reduce one of the major problems of the original Yxy color space: that equal distances on the x, y chromaticity diagram did not correspond to equal perceived color differences. In this color space, L* indicates lightness and a* and b* are the chromaticity coordinates.

Figure 4:
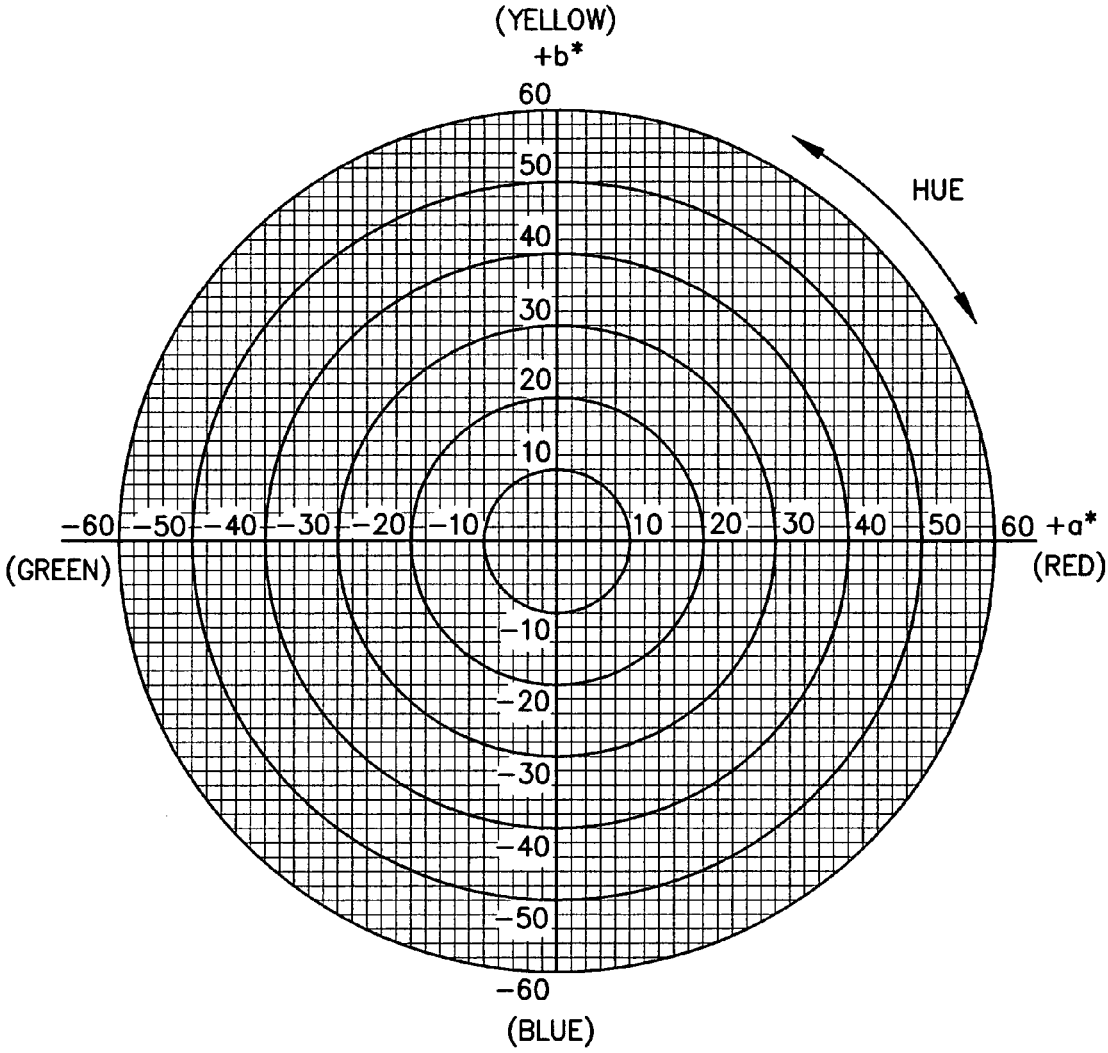
FIG. 4 is a schematic of a color space, showing a three-dimensional solid cut horizontally at a constant L* value.

FIG. 4 shows the a*, b* chromaticity diagram. In this diagram, the a* and b* indicate color directions: +a* is the red direction, −a* is the green direction, +b* is the yellow direction, and −b* is the blue direction. The center is achromatic; as the a* and b* values increase and the point moves out from the center, the saturation of the color increases.

Figure 5:
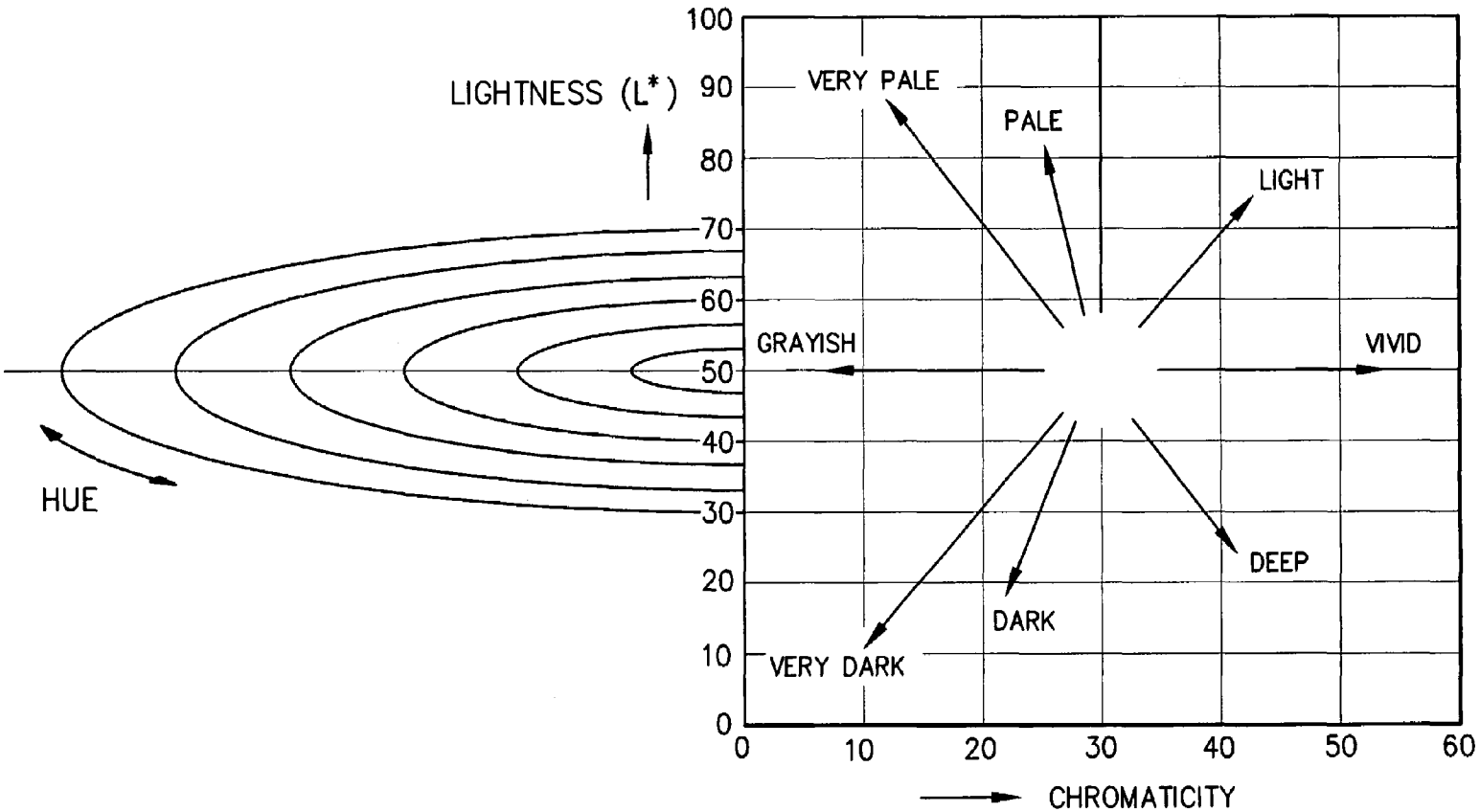
FIG. 5 shows a view of chromaticity versus lightness.

FIG. 4 is a view of a three-dimensional solid cut horizontally at a constant L* value. FIG. 5 shows a view of chromaticity versus lightness. FIG. 6 is a representation of the color solid for the L*a*b* color space.

For purposes of this specification and testing herein, several different light sources may be employed. The first light source employs a cool white fluoroescent source. See Table 3. The second light source employed was a daylight light source. The third light source was a horizon light source. Table 3 below specifically provides data obtained when evaluating the color shade of the first region (i.e. non-etched region), as compared to the second region of each sample. Four samples were reported in Table 3.

EXAMPLE 1

The following is an example of a method of producing a fabric with color contrast and three-dimensional surface geometry according to the invention. A 100% polyester pile fabric is continuously dyed a medium gray shade. The dye mix was composed of the following blend:

8.08 g/kg Yellow Disperse Dye (Dorospers Yellow KHM™—M Dohmen USA, Inc.)

0.63 g/kg Red Disperse Dye (Dorospers Red KFFN™—M Dohmen USA, Inc.)

3.04 g/kg Red Disperse Dye (Dianix Red BLS™—DyStar, Inc.)

8.55 g/kg Blue Disperse Dye (Terasil Blue GLF™—Ciba, Inc.)

0.66 g/kg Blue Disperse Dye (Dianix Blue BGE™—DyStar, Inc.)

33.3 g/kg Ultraviolet Inhibitor (Millitex® Millad 450™—Milliken Chemical)

1.0 g/kg Acetic Acid 10 g/kg Antimigrant (Astrotherm 111C™—Glotex Chemical)

Dye was applied to the fabric in a dye pad at about 60% wet pickup. The fabric was dried on a radio frequency dryer to ensure level and evenly distributed dye application during drying. At this stage the fabric had been dried, but dyes were not fixed in the fibers.

The fabric was printed with etching chemistry on a rotary screen print machine. In addition, two screens of color were added to the print. The etching chemistry employed was strongly alkaline, and was composed of:

70 g/kg Millitex® APG (Milliken Chemical)

235 g/kg Caustic Soda Beads

The fabric was printed at about 7 yards per minute, and entered a 5-zone, gas-fired Tenter at 350 degrees Fahrenheit. The etching chemistry was activated under heat, and the pile of the fabric was destroyed and/or eroded in the areas where the mixture was applied.

The dyes were fixed to the fabric by means of a superheated steamer. Fabric entered the steamer at a temperature of 180 degrees Celsius. The dwell time was about 8 minutes, which was adequate to fix the dyes.

The fabric proceeded through a continuous wash range. The degraded fibers, auxiliary chemicals, and remaining surface dyes were removed from the fabric. A reductive clearing of surface dyes was accomplished to remove residual dyes from the face of the fabric.

The fabric was dried on a 5-zone, gas-fired Tenter at a speed of about 25 yards per minute with a temperature of about 350 degrees Fahrenheit.

A color space coordinate evaluation was provided on the fabrics produced, comparing the etched regions to the non-etched regions to determine color shade variation. A positive % L* increase indicated that the etched region was lighter in shade than the non-etched (or non-eroded) region. Values are reported in Table 1 below.

TABLE 1

| | | |
|---|---|---|
| COOL WHITE | DELTA L* | 9.21 |
| | DELTA a* | −0.46 |
| | DELTA B* | 3.26 |
| | % L* INCREASE | 29 |
| DAYLIGHT | DELTA L* | 9.37 |
| | DELTA a* | −0.11 |
| | DELTA B* | 3.45 |
| | % L* INCREASE | 29 |
| HORIZON LIGHT | DELTA L* | 9.45 |
| | DELTA a* | −0.38 |
| | DELTA B* | 3.68 |
| | % L* INCREASE | 30 |

EXAMPLE 2

The procedure was performed as in Example 1, but instead using the following dyes with a foam dyeing application:

8.45 g/kg Yellow Disperse Dye (Dianix Yellow AM-SLR™—DyStar, Inc.)

6.75 g/kg Orange Disperse Dye (Dianix Orange AM-SLR™—DyStar, Inc.)

4.50 g/kg Red Disperse Dye (Dianix Red AM-SLR™—DyStar, Inc.)

26.3 g/kg Blue Disperse Dye (Dianix Blue AM-SLR™—DyStar, Inc.)

A color shade determination was made, and results are shown in Table 2, below.

TABLE 2

| | | |
|---|---|---|
| COOL WHITE | DELTA L* | 9.99 |
| | DELTA a* | 2.41 |
| | DELTA B* | −2.38 |
| | % L* INCREASE | 27 |
| DAYLIGHT | DELTA L* | 10.09 |
| | DELTA a* | 1.33 |
| | DELTA B* | −1.85 |
| | % L* INCREASE | 28 |
| HORIZON LIGHT | DELTA L* | 10.17 |
| | DELTA a* | 1.69 |
| | DELTA B* | −2.35 |
| | % L* INCREASE | 28 |

In the practice of the invention, it is possible to control the relative value or the change in delta L* value within a given sample, so as to regulate or "tune" the difference in delta L* value. It is possible to regulate this difference or change by controlling one or more of several process variables which include chemical composition, chemical concentration, drying conditions, printing conditions or other conditions related to the second regions 24*a-c* of the textile 20 (see FIG. 1).

Table 3 below shows the results of four samples that used four different printing conditions, as practiced by following Example 1 above. The four printing conditions provided variable amounts of paste pick-up in the etched regions. One variable employed was the screen pressure on the fabric. Importantly, each of the four samples showed varying degrees of % L* increase. This result indicates that different aesthetics can be achieved depending upon the desired result.

TABLE 3

Color Space Values for Various Selected Screen Printed Textile Samples

| | | Sample #1 | Sample #2 | Sample #3 | Sample #4 |
|---|---|---|---|---|---|
| COOL WHITE | DELTA L* | 12.74 | 15.31 | 8.69 | 11.45 |
| | DELTA a* | 1.89 | 0.89 | 0.8 | 1.5 |
| | DELTA b* | 7.52 | 8.95 | 5.67 | 8.03 |
| | % L* INCREASE | 40 | 51 | 25 | 37 |
| DAYLIGHT | DELTA L* | 13.36 | 15.9 | 9.11 | 12.01 |
| | DELTA a* | 1.34 | 0.56 | 0.53 | 1.03 |
| | DELTA b* | 8.49 | 9.94 | 6.33 | 9.01 |
| | % L* INCREASE | 41 | 53 | 26 | 38 |
| HORIZON LIGHT | DELTA L* | 13.61 | 16.14 | 9.27 | 12.02 |
| | DELTA a* | 2.35 | 1.88 | 1.29 | 2.39 |
| | DELTA b* | 8.81 | 9.84 | 7.49 | 9.14 |
| | % L* INCREASE | 42 | 53 | 27 | 38 |

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A method of making a woven or knitted fabric having corresponding color contrast and surface geometry contrast between first regions and second regions in the fabric, said method comprising:

(a) providing a polyester fabric, said fabric having yarns forming a pile, said first pile having a first pile height, said fabric having first regions and second regions;

(b) applying an unfixed dye to said pile of said fabric;

(c) drying said fabric produced in step (b) by application of electromagnetic radio frequency energy to the fabric, said drying step being performed under conditions sufficient to at least partially dry said fabric but without fixing a substantial portion of said unfixed dye to said pile of said fabric, (d) selectively applying a chemical etching agent to said pile of said fabric, said agent being an alkaline paste applied to one or more second regions of said pile of the fabric and not applied to the first regions of the fabric, said yarn-degrading composition being effective to degrade yarns in said second regions, thereby forming in said second regions yams having a second pile height; and (e) reacting the chemical etching agent with one or more second regions of the pile of the fabric, thereby etching the yarns or fibers in the one or more second regions to produce yarns or fabers having a second height, the second height being less than the first height;

(f) heating the fabric resulting from step (e) in a superheated steamer to fix the dye to the yarns or fibers in the first and second regions of the pile of the fabric, wherein the heating temperature is about 180 degrees C.;

(g) drying the fabric at elevated temperature;

(h) thereby producing a fabric having a pile on a surface thereof with yarms of the second region exhibiting a different dyed color than yarns or fibers of regions;

(i) thereby forming a fabric having first regions of a first pile height and second regions of a second pile height, said second pile height being less than said first pile height and each of said respective regions having respective first and second ΔL* values, and the difference between the first ΔL* value and the second ΔL* value is equal to about 10% or more of the total first ΔL* value.

2. The method of claim 1 wherein said color contrast ΔL* value at least about 25 percent difference in color contrast between said first and second regions.

3. A method for making a fabric having regions exhibiting different pile heights and a color contrast between said regions exhibiting different pile height, the method comprising the steps of:

(a) providing a polyester fabric having a pile on one side thereof, said pile comprising a plurality of yarns or fibers having a first height, (b) applying in an aqueous process an unfixed dye to said pile of said fabric, (c) drying said fabric produced in step (b) by application of electromagnetic radio frequency energy to the fabric, said drying step being performed under conditions sufficient to at least partially dry said fabric but without fixing a substantial portion of said unfixed dye to said pile of said fabric, (d) selectively applying a chemical etching agent to said pile of said fabric, said chemical etching agent being an alkaline paste, the agent being applied to one or more second regions of said pile of said fabric and not applied to one or more first regions of said pile of said fabric, (e) reacting said chemical etching agent with said one or more second regions of said pile of said fabric, thereby etching said yarns or fibers in said one or more second regions to produce yarns or fibers having a second height, said second height being less than said first height, and (f) heating said fabric produced in step (e) in a superheated steamer to fix said dye to said yarns or fibers in said first and second regions of said pile of said fabric$_1$ said heating temperature being at least about 180 degrees C.;

(g) washing the fabric to remove residual chemical agent and unfixed dye remaining on the fabric; and (h) drying the fabric at elevated temperature;

(i) thereby producing a fabric having a pile on a surface thereof, said pile comprising a plurality of yarns or fibers in one or more first regions having a first height and one or more second regions having a second height, said second height being less than said first height, and said yarns or fibers in said second region exhibiting a different color than said yarns or fibers in said first region;

(j) wherein the yarns or fibers in the first region exhibit a first L* value, the yarns or fibers in the second region exhibit a second L* value, and the difference between the first L* value and the second L* value is equal to about 10% or more of the first L* value.

* * * * *

UNITED STATES PATENT AND TRADEMARK OFFICE

CERTIFICATE OF CORRECTION

PATENT NO. : 7,435,264 B2
APPLICATION NO. : 10/706807
DATED : October 14, 2008
INVENTOR(S) : Mark Kiff It is certified that error appears in the above-identified patent and that said Letters Patent is hereby corrected as shown below:

In column 8, line 48 delete the word "yams" and replace with the word - yarns -.

In column 8, line 61 delete the word "yarms" and replace with the word - yarns -.

In column 10, line 11 "chemical agent" should read "chemical etching agent" insert the word -- etching --.

Signed and Sealed this

Twenty-fourth Day of February, 2009

JOHN DOLL
*Acting Director of the United States Patent and Trademark Office*